US007116796B1

(12) United States Patent
Reenberg

(10) Patent No.: US 7,116,796 B1
(45) Date of Patent: Oct. 3, 2006

(54) DIAPHRAGM TRANSDUCER

(75) Inventor: Nils Peter Reenberg, Svenstrup (DK)

(73) Assignee: NanoNord A/S, Aalborg Øst (DK)

( * ) Notice: Subject to any disclaimer, the term of this patent is extended or adjusted under 35 U.S.C. 154(b) by 98 days.

(21) Appl. No.: 10/069,978

(22) PCT Filed: Sep. 13, 2000

(86) PCT No.: PCT/DK00/00504

§ 371 (c)(1),
(2), (4) Date: Mar. 14, 2002

(87) PCT Pub. No.: WO01/20949

PCT Pub. Date: Mar. 22, 2001

(30) Foreign Application Priority Data

Sep. 14, 1999 (DK) ..... 1999 01294

(51) Int. Cl.
*H04R 25/00* (2006.01)

(52) U.S. Cl. ..... 381/431; 381/176; 381/152; 381/408

(58) Field of Classification Search ..... 381/152, 381/337, 414, 408, 431, 399, 176
See application file for complete search history.

(56) References Cited

U.S. PATENT DOCUMENTS 4,354,066 A 10/1982 Necoechea
4,491,698 A * 1/1985 Larson et al. ..... 381/408
5,195,143 A 3/1993 Spiegel et al.
5,297,214 A * 3/1994 Bruney ..... 381/431
5,627,903 A * 5/1997 Porrazzo et al. ..... 381/423

FOREIGN PATENT DOCUMENTS

| | | |
|---|---|---|
| EP | 0 587 910 A1 | 3/1994 |
| GB | 2 137 047 A | 9/1984 |
| WO | WO 98/20705 A1 | 5/1998 |

* cited by examiner

*Primary Examiner*—Huyen Le
*Assistant Examiner*—Tuan Duc Nguyen
(74) *Attorney, Agent, or Firm*—Nixon Peabody LLP; David S. Safran

(57) ABSTRACT

A new type of diaphragm transducer comprising magnets to provide magnetic field strength in a planar region and a planar diaphragm located in the said planar region. The diaphragm has a plurality of conductors on its planar surface for inducing electromagnetic forces acting on theses conductors in said planar region when current flows through said conductors. The magnets are arranged in magnetic interaction with a magnetically conducting material, preferably soft iron, to conduct magnetic field from said magnets to said planar region.

9 Claims, 4 Drawing Sheets

DIAPHRAGM TRANSDUCER

The present invention relates to a diaphragm transducer as described in the preamble of claim 1.

As loudspeakers, mainly two types are common. The one type comprises an annular coil disposed in a transverse magnetic field, where the coil is connected to a diaphragm, usually conical in shape. Current flowing through the coil results in a force moving the diaphragm. The second type comprises a planar diaphragm, where conductors are positions on the planar surface. A magnetic assembly behind or at the sides of the membrane result in displacement of the membrane, when current flows through the conductors.

It is well known, that the second type of loudspeaker is more expensive to manufacture as compared to the first type and the efficiency is lower. However, the quality of the emitted sound is much better in the second type, as it does not suffer from distortions of the membrane to the same extend as the first type.

An example of a loudspeaker with a planar diaphragm transducer is described in U.S. Pat. No. 5,195,143. With reference to a drawing in that reference, which is reproduced in FIG. 1*a*, a woofer diaphragm 100 is located in front of an assembly of magnets 102 where magnetic field lines 104 propagate between corresponding north poles, N, and south poles, S. In order to produce proper sound, the diaphragm 100 has to move transversely to the plane of the diaphragm, which requires magnetic field lines 104 which are parallel to the plane and normal to the conductors on the diaphragm. However, as can be seen from FIG. 1*a*, a large portion of indicated field lines 104, are normal and not parallel to the diaphragm 100, resulting in low efficiency of the loudspeaker and distortion at higher currents.

Figure 1A:
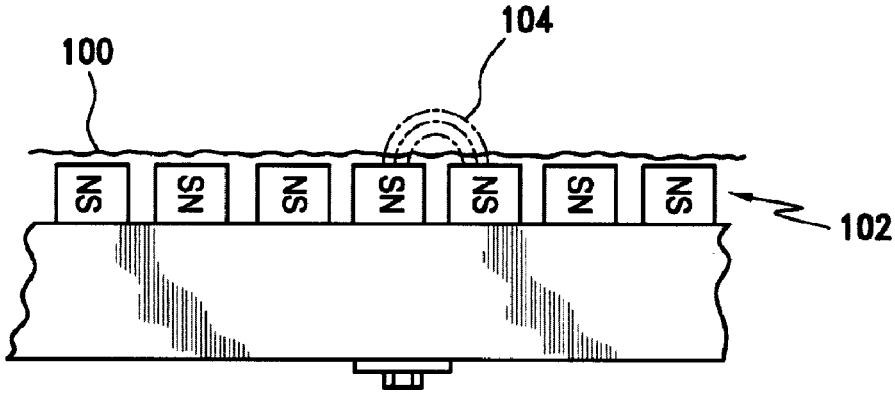
FIG. 1a (Prior Art)
Figure 1B:
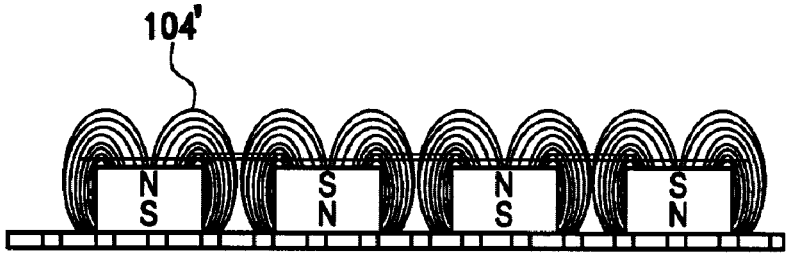
FIG. 1b (Prior Art)

Meanwhile, further study of the problem has shown, that the magnetic field lines 104', actually, do not propagate as shown on FIG. 1*a*, but rather propagate as shown in FIG. 1*b*, which explain the low efficiency of this type of loudspeaker, as the majority of magnetic field line propagate transversely to the diaphragm plane, which is inappropriate.

Figure 2A:
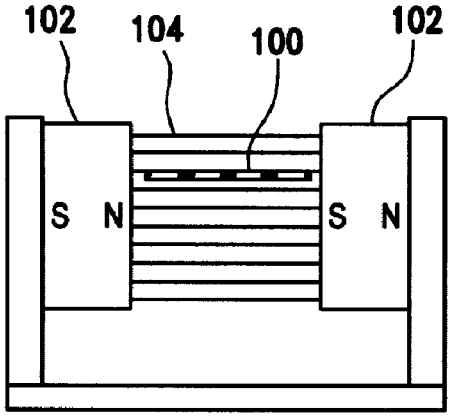
FIG. 2a (Prior Art)

As shown in FIG. 2*a*, according to prior art, it is possible to arrange magnets 102 such that the magnetic field lines are more parallel to the diaphragm 100, for example by placing the diaphragm 100 between a north and a south poles, where the diaphragm is normal to the surface of the poles. This arrangement, however, is only suitable for small diaphragms because of the required narrow space between the poles. Therefore, it is only used for loudspeakers in the high frequency regime and not for woofers. It is generally assumed for this arrangement, as shown in FIG. 2*a*, that the field lines 104 propagate from the left north pole of the arrangement to the right south pole.

Figure 2B:
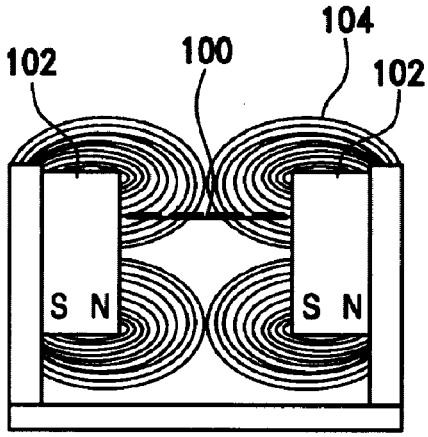
FIG. 2b (Prior Art)

However, study of this arrangement has shown that the field lines propagate as indicated in FIG. 2*b*, which illustrates the insufficiency of this arrangement. The field is very weak at the centre of the arrangement, and placing the diaphragm off-centre as shown in FIG. 2*b* results in field lines not parallel with the diaphragm.

A number of attempts have been undertaken to improve this type of loudspeakers, where the main effort has been put into the shaping of the magnetic field in the region in which the diaphragm is moved. In U.S. Pat. No. 4,491,698, a diaphragm transducer is disclosed having a planar diaphragm with vanes extending perpendicular from the diaphragm and into a magnetic arrangement behind the diaphragm. However, no suitable solution has yet been found, notwithstanding the fact that this principle for loudspeakers has been existing for a long time.

In U.S. Pat. No. 4,354,066, a non-planar, rigid-diaphragm transducer is disclosed whith a coil for interaction with a magnetic field, where the coil support is outside the diaphragm. In U.S. Pat. No. 5,297,214 a loudspeaker is disclosed with a planar diaphragm having thin conductors thereon. The magnetic field is provided by an arrangement of permanent magnets on one side of the diaphragm.

It is an object of the invention to provide a diaphragm transducer of the above mentioned second type with a higher efficiency than known systems. It is a further object of the invention to provide a transducer with higher efficiency which is also cheap and easy to manufacture.

This object is achieved with a diaphragm transducer as mentioned by way of introduction which is characterised as described in the characterising part of claim 1.

Using ferromagnetic material as soft iron in connection with loudspeakers of the second type is a very simple solution because the shaping of a magnetic field is much easier with ferromagnetic material than with magnets. Magnetic field lines are changed with respect to their direction when traversing soft iron because the magnetic reluctance in soft iron is much lower than in air.

In the following, soft iron will be used as a synonym for a magnetically conducting material. However, the magnetically conducting material can also be other material than soft iron with analogue properties and not being a permanent magnet. Possible other materials are iron-silicon, Permalloy, or iron-oxides.

According to further study of the invention, it has turned out, that it is possible to achieve an approximately constant magnetic field in the planar region where the diaphragm is located.

Shaping of the magnetic field can be achieved by applying plates of soft iron between which permanent magnets are located. One edge of each of said plates constitutes a magnetic pole in said configuration. For example, an arrangement can comprise three poles, two outer poles of equal polarity and one inner pole of opposite polarity.

The intensity of the magnetic field depends on the field strength of the magnets that are placed between the soft iron plates. But as the conduction of the magnetic field lines from the magnets, through the soft iron plates, and to the diaphragm is efficient, the invention opens the possibility to achieve high field strengths in the planar region even with relatively weak and cheap magnets. That has as a consequence, that this type of loudspeaker can be produced much cheaper than hitherto and for a price that can compete with the price for loudspeakers with annualar coils. Therefore, a large number of people, that could not afford this type of loudspeaker before, will be able to enjoy a clearer and more differentiated sound of music in their homes.

Surprisingly, it has turned out, as intense studies have shown, that it is a great advantage, if the inner poles located between the outer poles are arranged in pairs with a distance between the two plates constituting said pair. As compared with single inner poles, the magnetic field in the plane in front of the double poles is much more constant in strength and direction.

Because of the magnetic field in the planar region can be shaped to be approximately constant, the conductors on the diaphragm can easily be oriented and connected such that, when current flows through those conductors, the electromagnetic forces acting on the conductors in the planar region are approximately in the same direction normal to the plane of the diaphragm. This is the ideal case, but as the introductory discussion showed, that this has by far not been achieved in systems according to prior art.

Even higher field strengths can be achieved when the field is allowed to vary with a small amount. Small field strength variations can be adjusted for by placing the conductors on the diaphragm with varying mutual distances and directions.

To achieve a better performance of a transducer according to the invention, the diaphragm in a transducer may have a ferromagnetic magetisable layer. The layer can be part of the diaphragm material or be applied as a coating.

According to prior art, ferromagnetic magnetisable material as ferric oxide, Permalloy or soft iron has been used on annular coils in loudspeakers of the first type, for example in UK patent application GB 2,137,047 or in European patent application EP 587 910. The effect in these papers was damping and increasing the efficiency. For the above mentioned second type of loudspeaker, it has not been recognised that an improvement can be achieved.

However, as with the soft iron plates, a magnetically conducting layer in or on the diaphragm, for example a coating with soft iron, conducts the field lines along the diaphragm. The result is an increased number of field lines parallel with the diaphragm enhancing the efficiency of the transducer.

A soft iron coating on the diaphragm should be very thin and does, therefore, not conflict with the aim that the transducer diaphragm should have a very low mass. Once accelerated because of the current through the conductor in the magnetic field, a diaphragm with a higher mass will be harder to stop than a diaphragm with a lower mass. This might result in an overshooting of the diaphragm at peak currents with a result of sound distortions. A damping of the diaphragm may be achieved with the ferromagnetic material on the diaphragm. As the diaphragm moves in the magnetic field, the magnetic field changes causing a different magnetisation of the coating. The change in the magnetisation has the effect of damping the motion of the membrane, especially at large excursions. The damping ability is dependant on the magnetic hysteresis of the ferromagnetic material. Soft iron has a very low hysteresis, while Permalloy has a larger hysteresis. Which material is the best depends on the actual construction of the diaphragm transducer, especially, whether it is designed to work at higher or lower frequencies. As a rule of thumb, it should be mentioned here, however, that the lower the working frequency of the transducer, the higher a damping is needed.

The invention will be described further with reference to the drawing where

Figure 3:
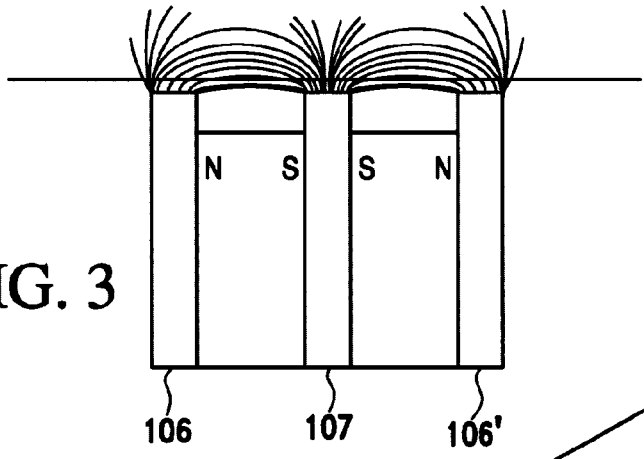

FIG. 1 illustrates the principle of a planar transducer according to prior art, FIG. 2 illustrates the principle of a different transducer according to prior art, FIG. 3 illustrates the principle of diaphragm transducer according to the invention, FIG. 4 is a schematic view diaphragm transducer according to the invention.

Figure 5A:
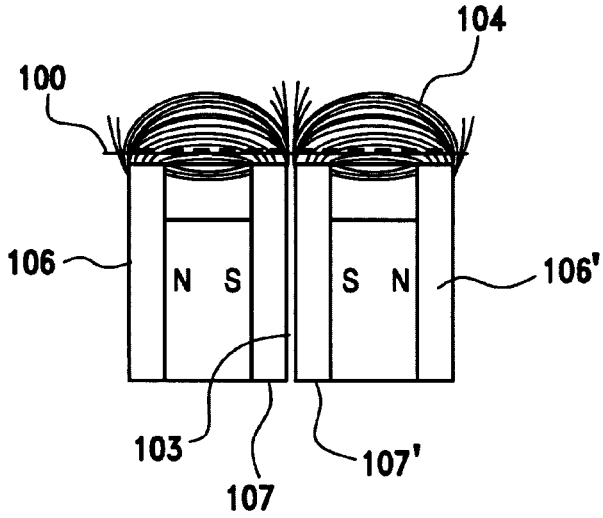
Figure 5B:
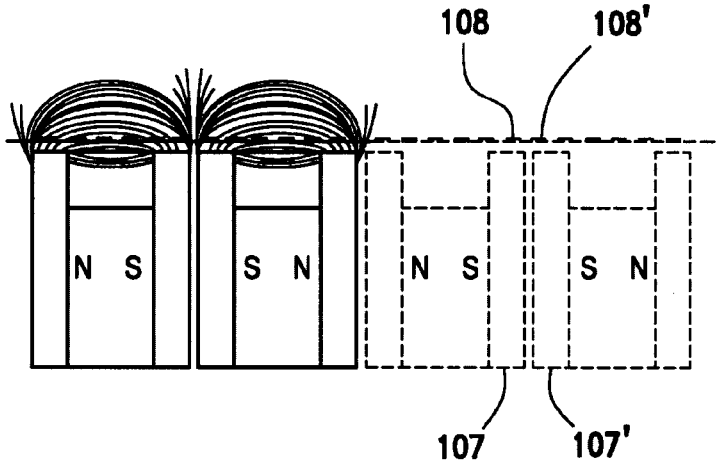

FIGS. 5*a* & 5*b* show embodiments of the invention which have a plurality of pairs of poles.

FIG. 3 shows a diaphragm transducer according to the invention. Two magnets 102 with corresponding north poles, N, and south poles, S, are arranged in magnetic interaction with plates of soft iron 106. Each magnet 102 can consist itself of a number of smaller magnets acting in combination. The shown arrangement comprises three magnetic poles, two outer poles 106 and 106' of equal polarity, N, and an inner pole 107 of opposite polarity, S.

The construction as shown in FIG. 3 has a number of advantages. First, magnets are arranged behind the diaphragm and not beside the diaphragm. Therefore be built in a more narrow and more aesthetic design than hitherto. The necessary mass of the magnets 102 is stored behind the diaphragm 100. Second, to achieve a high field strength, relatively large magnets 102 or many magnets in combination can be used. thus, it is possible to achieve high field strengths even with magnets 102 that are low in production cost, which results in a low production cost of the transducer itself. Third, shaping of the field in the planar region of the diaphragm is relatively easy. To shape the field at the diaphragm, only the plates 106, 106', 107 have to be shaped, which is far more easy than shaping eventually brittle magnets 102. Fourth, assembly of the magnetic arrangement is easy and quick once the plates 106, 106', 107 are shaped.

Figure 4A:
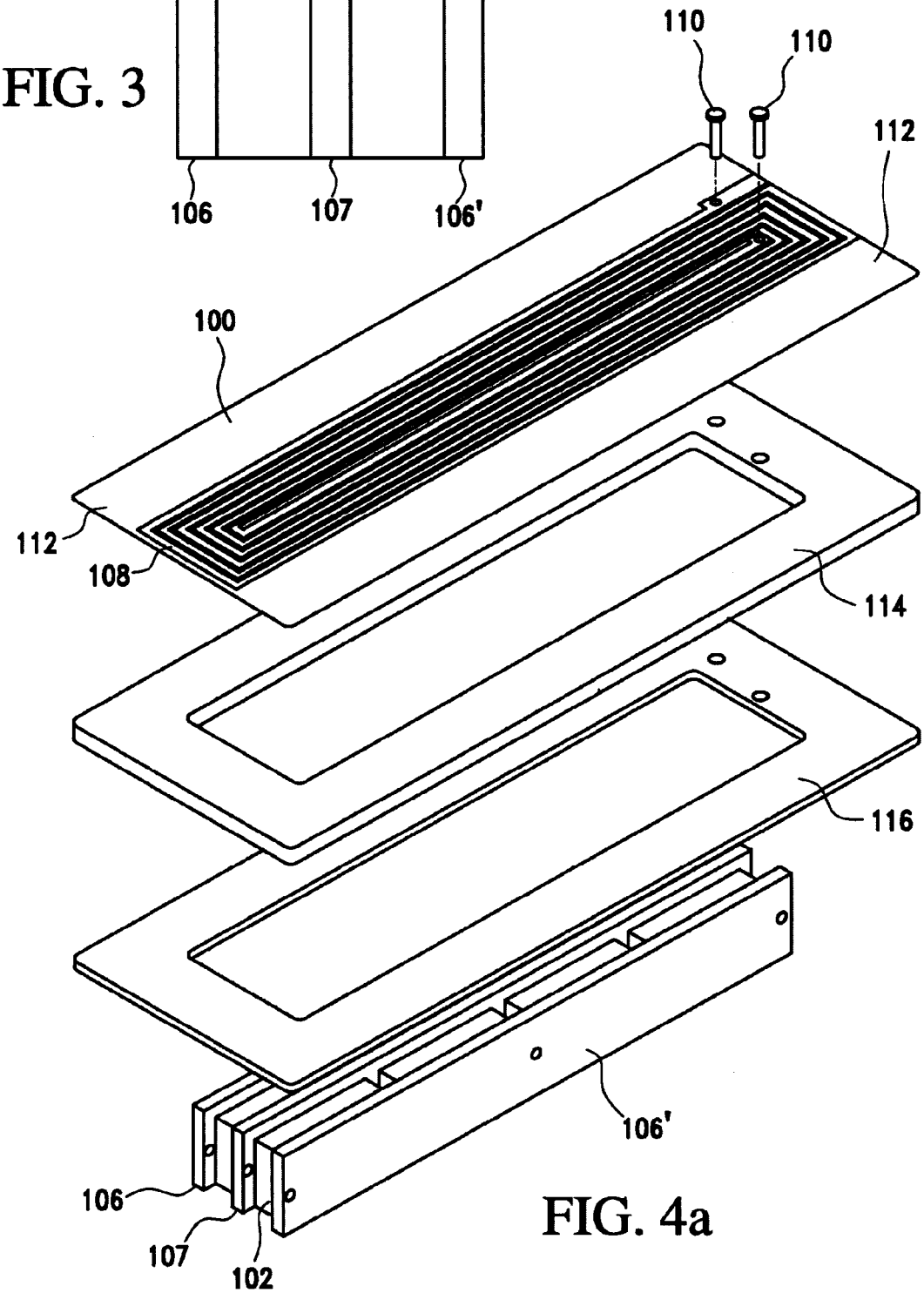

FIG. 4*a*. shows the transducer according to the invention in an exploded view. The diaphragm 100 is equipped with conductors 108 that are mutually connected, for example in a spiral arrangement as indicated on the figure. Current is applied to the conductors by appropriate connectors 110. The diaphragm is supported by a frame 114 of damping material, for example foam polymer. The structural support frame 116 of a rigid material secures a proper positioning of the magnets 102 and soft iron plates 106, 106', 107 with respect to the diaphragm 100.

Figure 4E:
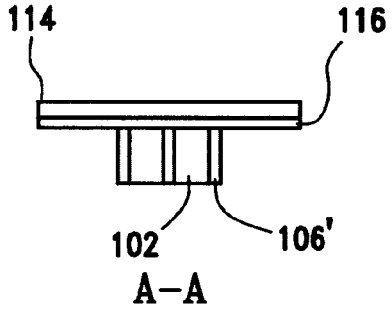
Figure 4B:
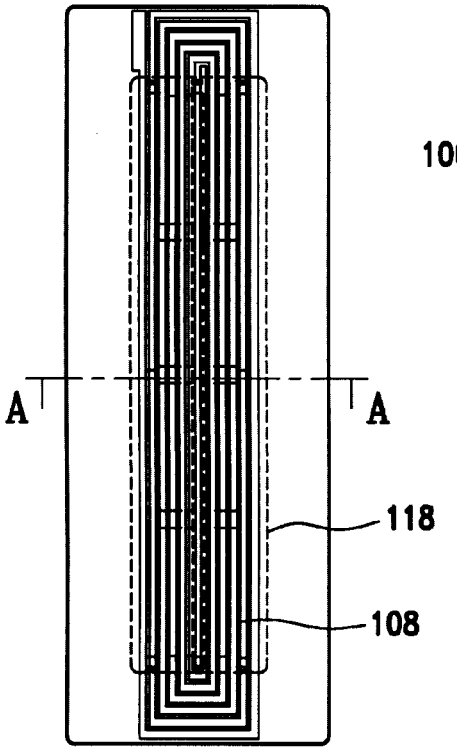
Figure 4C:
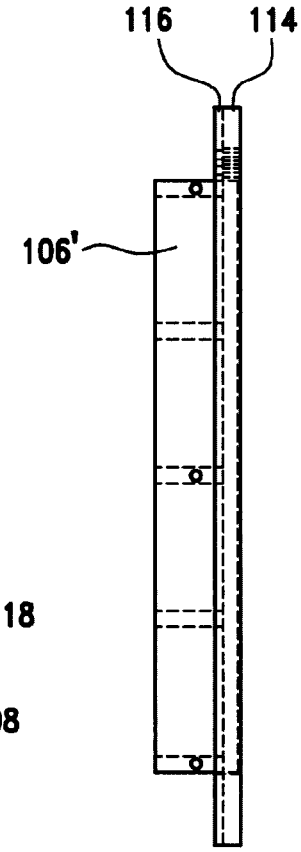
Figure 4D:
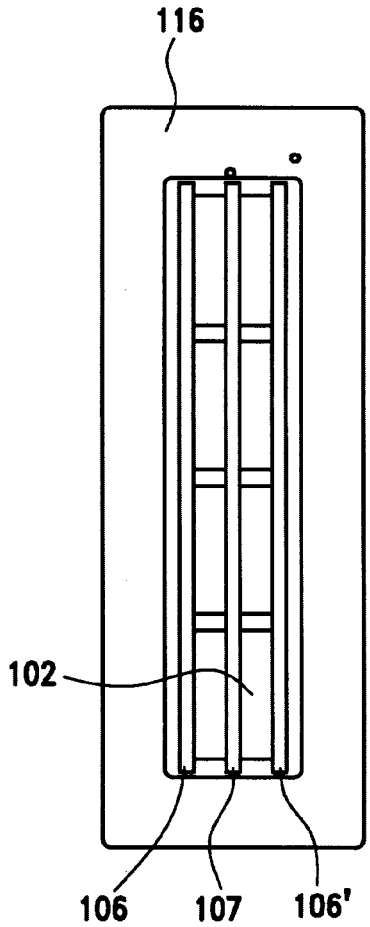

A drawing of the assembly is shown in FIGS. 4*b* through 4*e*, where FIG. 4*b* is a front view, FIG. 4*c* is a side view, FIG. 4*d* is a back view, and FIG. 4*e* is a view along the cut A—A as indicated on FIG. 4*b*. It can be seen, that only the longitudinal parallel conductors 108 are within the planar region 118 where the magnetic field has a high strength.

An alternative construction for a transducer according to the invention is achieved by fixing the diaphragm only at its end 112, 112', whereby the polymer support 114 can be omitted.

As described before, and illustrated in FIG. 5*a*, it has turned out that it is a great advantage, if the inner pole located between the outer poles is arranged in pairs 107,107' with a distance 103 between the two plates 107, 107' constituting that pair. As compared with single inner poles, the magnetic field in the plane in front of the double poles 107, 107' is much more constant in strength and direction, which has been confirmed by experiment, but has not yet been completely understood.

The magnetic field 104 lines are in reality much more parallel with the diaphragm 100 than those drawn on FIG. 5*a*, as the field lines on the figure only serve for illustration.

In analogy to the arrangement in FIG. 5*a*, another arrangement with a plurality of pairs of poles is shown in FIG. 5*b*.

The diaphragm is equipped with a number of conductors 108. In front of the inner poles 107, 107', the conductor 108, 108' have approximately the same distance 103 as the plates 107, 107'. For a high frequency loudspeaker, this distance is between 0.1 and 3 mm, preferably between 0.3 and 1.5 mm and mostly preferred between 0.4 and 0.6 mm.

The invention claimed is:

1. Diaphragm transducer comprising a planar diaphragm having a plurality of conductors on a region of a planar surface thereof, magnets arranged on one side of said diaphragm to provide magnetic field strength through said planar diaphragm for inducing electromagnetic force acting on said conductors when current flows through said conductors, wherein said magnets are in magnetic interaction with a magnetically conducting material to conduct magnetic field strength from said magnets to said diaphragm, said magnetically conducting material is not a permanent magnet, said magnetically conducting material is configured as plates on said one side of the diaphragm between which permanent magnets are located, where one edge of each of said plates constitutes a magnetic pole, said edges of said plates are arranged only on one side of said region for providing field strength through said diaphragm with magnetic field lines substantially parallel with said region, and said conductors on said diaphragm are arranged in a pattern in relation to said magnetic field strength through said diaphragm, said relation being such that said electromagnetic force acting on said conductors is directed substantially normal to said surface of said planar diaphragm.

2. Diaphragm transducer according to claim 1, wherein said conductors are arranged in a pattern with varying mutual distances and directions.

3. Diaphragm transducer according to claim 1, wherein that said magnetic field through said diaphragm is approximately constant.

4. Diaphragm transducer according to claim 1, wherein the number of poles are at least three with two outer poles and at least one inner pole.

5. Diaphragm transducer according to claim 4, wherein said number of inner poles located between the outer poles is at least two, where said inner poles are arranged in pairs of poles with a distance between the two plates constituting said pair.

6. Diaphragm transducer according to claim 5, wherein said distance between said two plates constituting a pair of poles, is between 0.1 and 3 mm, preferably between 0.3 and 1.5 mm and preferably between 0.4 and 0.6 mm.

7. Diaphragm transducer according to claim 1, wherein said magnetically conducting material is soft iron.

8. Diaphragm transducer according to claim 1, wherein said diaphragm comprises a magnetically conducting layer.

9. Diaphragm transducer according to claim 8, wherein said magnetically conducting layer comprises at least one from the group consisting of a coating with soft iron and a coating with Permalloy.

* * * * *